US008800177B2

(12) United States Patent
Harrington

(10) Patent No.: US 8,800,177 B2
(45) **Date of Patent: *Aug. 12, 2014**

(54) PNEUMATIC EXCAVATION SYSTEM AND METHOD OF USE

(71) Applicant: Steve Harrington, Cardiff, CA (US)

(72) Inventor: Steve Harrington, Cardiff, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/162,652

(22) Filed: Jan. 23, 2014

(65) Prior Publication Data

US 2014/0130383 A1 May 15, 2014

Related U.S. Application Data

(63) Continuation-in-part of application No. 13/094,136, filed on Apr. 26, 2011.

(60) Provisional application No. 61/881,896, filed on Sep. 24, 2013.

(51) Int. Cl.

| | |
|---|---|
| ***E02F 3/00*** | (2006.01) |
| ***E02F 9/20*** | (2006.01) |
| ***F15B 21/12*** | (2006.01) |
| ***E02F 9/24*** | (2006.01) |
| ***E02F 3/92*** | (2006.01) |
| ***E02F 9/26*** | (2006.01) |
| ***E02F 9/22*** | (2006.01) |

(52) U.S. Cl.

CPC ..... *E02F 3/9206* (2013.01); *E02F 9/205* (2013.01); *F15B 21/12* (2013.01); *E02F 9/245* (2013.01); *E02F 9/261* (2013.01); *E02F 9/2267* (2013.01); *E02F 9/2221* (2013.01)

USPC ..... 37/344; 89/1.13

(58) Field of Classification Search

USPC ..... 37/307, 309, 342, 344; 89/1.13; 299/16, 299/17

See application file for complete search history.

(56) References Cited

U.S. PATENT DOCUMENTS

| | | | | |
|---|---|---|---|---|
| 2,047,027 | A * | 7/1936 | Le Bleu | 37/428 |
| 2,717,804 | A | 9/1955 | White | |
| 2,960,368 | A * | 11/1960 | Watanabe | 37/323 |
| 3,042,315 | A | 7/1962 | Besser | |
| 3,248,812 | A | 5/1966 | Gardner | |
| 3,620,457 | A | 11/1971 | Pearson | |
| 4,008,644 | A * | 2/1977 | Kayser | 89/1.13 |
| 4,149,739 | A | 4/1979 | Morris | |
| 4,760,656 | A | 8/1988 | East | |
| 4,919,585 | A | 4/1990 | Ruiz | |
| 4,936,031 | A | 6/1990 | Briggs | |
| 4,991,321 | A | 2/1991 | Artzberger | |
| 5,129,167 | A | 7/1992 | Nakahara | |
| 5,170,943 | A | 12/1992 | Artzberger | |
| 5,212,891 | A | 5/1993 | Schuermann | |
| 5,288,172 | A | 2/1994 | Reuhl | |

(Continued)

*Primary Examiner* — Jamie L McGowan

(74) *Attorney, Agent, or Firm* — Manuel de la Cerra

(57) ABSTRACT

An excavation system employing a high-pressure pulsed air jet in combination with a low-pressure high velocity blower for excavating improvised explosive devices or other buried objects. The excavation system may also be employed to operate a pneumatic tool such as a cut-off tool or a chisel. The high velocity blower may incorporate a bifurcated fan duct having two air outlets. The system may include a pressure control module for regulating the from a high-pressure air source to an evacuation valve. The evacuation valve employs first and second valves where the second valve controls the operation of the first valve.

14 Claims, 13 Drawing Sheets

(56) References Cited

U.S. PATENT DOCUMENTS

| | | | | |
|---|---|---|---|---|
| 5,291,819 | A | 3/1994 | Hambric | |
| 5,487,229 | A | 1/1996 | Nathenson | |
| 5,782,414 | A | 7/1998 | Nathenson | |
| 5,860,232 | A | 1/1999 | Nathenson | |
| 5,887,667 | A | 3/1999 | Van Zante | |
| 5,966,847 | A | 10/1999 | Nathernson | |
| 6,158,152 | A | 12/2000 | Nathenson | |
| 6,202,330 | B1 | 3/2001 | Bolton | |
| 6,957,506 | B1 | 10/2005 | Fair | |
| RE38,872 | E | 11/2005 | Hayes | |
| 7,093,774 | B2 | 8/2006 | Martin | |
| 7,114,880 | B2 | 10/2006 | Carter | |
| 7,631,444 | B1 * | 12/2009 | Hursen | 37/322 |
| 8,567,299 | B2 * | 10/2013 | Kokot et al. | 89/1.13 |
| 2007/0063066 | A1 * | 3/2007 | Vijay et al. | 239/99 |
| 2014/0028078 | A1 * | 1/2014 | Kolle | 299/29 |

* cited by examiner

PNEUMATIC EXCAVATION SYSTEM AND METHOD OF USE

1.0 CLAIM OF PRIORITY

The present application claims priority as a non-provisional of Ser. No. 61/881,896 filed on Sep. 24, 2013, and as a continuation in part of application Ser. No. 13/094136 filed on Apr. 26, 2011. These applications are herein incorporated by reference in their entirety.

2.0 TECHNICAL FIELD

The present invention relates to an excavating system and a method for using the excavation system. More specifically, this invention relates to a pneumatic excavating device that uses a supersonic or high-pressure pulsed air jet in combination with a low-pressure high velocity blower to excavate or dig in the ground. The device can be employed to excavate or unearth buried items such as but not limited to an improvised explosive device (IED). The system of the present invention can also be employed to remove an IED from the ground and/or to detonate an IED.

3.0 BACKGROUND

Pneumatic excavation systems of the prior air have previously employed high speed pulsed air jets such as Nathenson et al (U.S. Pat. No. 6,158,152). Nathenson et al (hereinafter "Nathenson") employs a hand held or a vehicle-attached device that employs a high-pressure pulsed air jet to uncover buried unexploded ordinance. One distinct disadvantage of the system of Nathenson is that personnel operating the device are in close proximity to the unexploded ordnance. Nathenson does not teach employing a second or an additional air source for use in conjunction with a pulsed air jet for pneumatic excavation. The need remains for improvements to pneumatic excavation systems in a safe and effective manner. The present invention addresses the deficiencies in the prior art.

4.0 SUMMARY

One aspect of the present invention is to provide an excavation system that employs two sources of air, a high-pressure pulsed air jet and a low-pressure high velocity air source. The low-pressure high velocity air source improves the digging capability of the device by assisting in the clearing or removal of the debris dislodged by the high-pressure pulsed air jet. The low-pressure air source also prevents the debris from falling back into the excavated site.

Another embodiment may be a kit that can retrofit an existing robot. This removes the need to have personnel in close proximity to the explosive device and provides existing robots with an alternative function. In another embodiment, an existing encrypted wireless communication channel is used in the operational control unit of the robot. This simplifies the integration of the excavating system to an existing robot.

Another embodiment provides a robot mounted excavation system that can be employed to perform other tasks such as operating a pneumatic tool.

In yet another embodiment, a method of excavation is disclosed. The method includes providing a robot with a nozzle for delivering a high-pressure pulsed air jet with a valve in communication with the nozzle, connecting the valve to a high pressure air source, providing a low-pressure high velocity blower adjacent the valve, and using the high-pressure pulsed air jet in combination with the high velocity blower during excavation. Other related method steps are also disclosed herein.

Other aspects of the invention are disclosed herein as discussed in the following Drawings and Detailed Description.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

6.0 DETAILED DESCRIPTION OF EXAMPLE EMBODIMENTS

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims.

Figure 1:
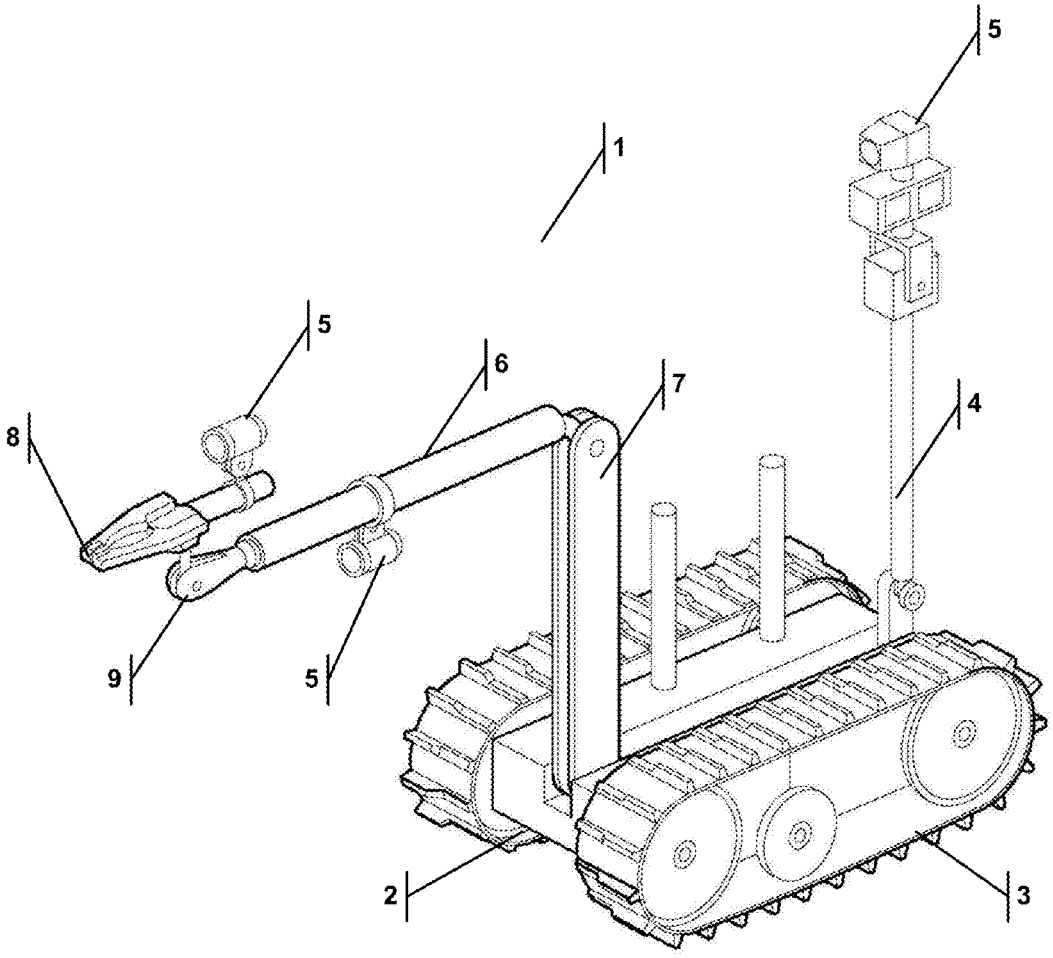
FIG. 1 is an elevation view of a prior art robot.

In certain embodiments, the present invention may be used with the prior art robot 1 seen in FIG. 1. The robot 1 includes a mobile platform 2 with tracks 3. The mobile platform 2 may include a rear mast 4 with a camera 5 mounted thereon. The mobile platform 2 includes with an upper arm 6 moveably connected to a lower arm 7. The upper arm 6 can include a gripper 8 and may include one or more cameras 5 mounted thereon. The lower arm is moveably connected to the mobile platform 2. The gripper 8 is pivotally attached to the end of the upper arm 6 by joint 9. The connection between joint 9 and upper arm 6 allows rotation of joint 9 independently of upper arm 6.

Figure 2A:
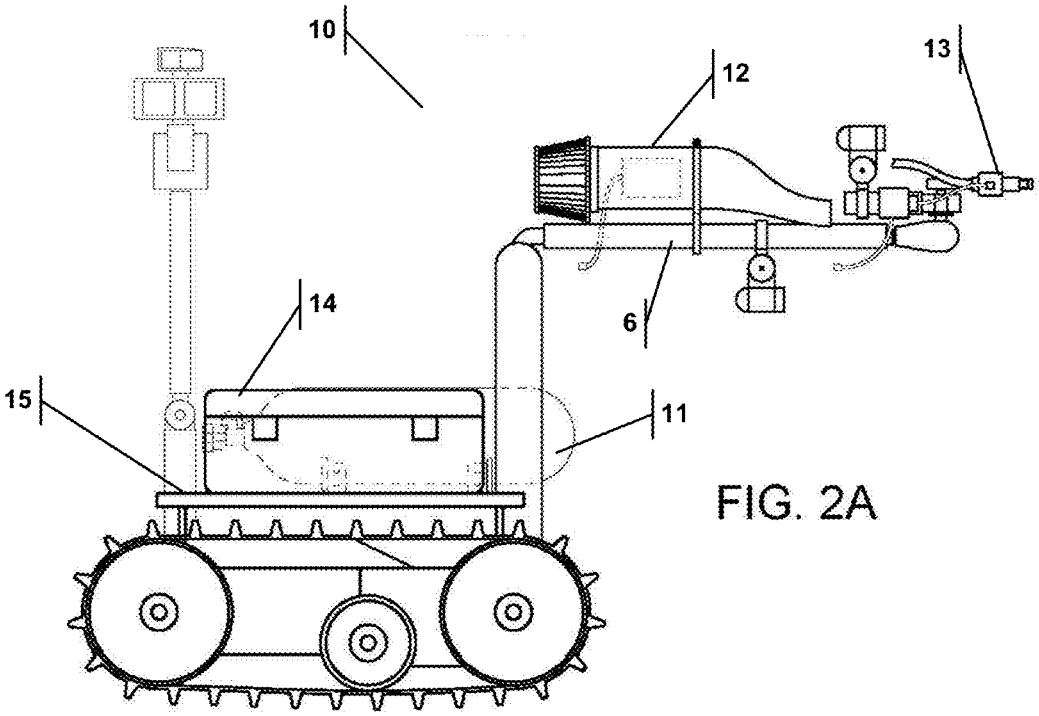
FIG. 2A is a right side view of the excavation system mounted on a robot.
Figure 2B:
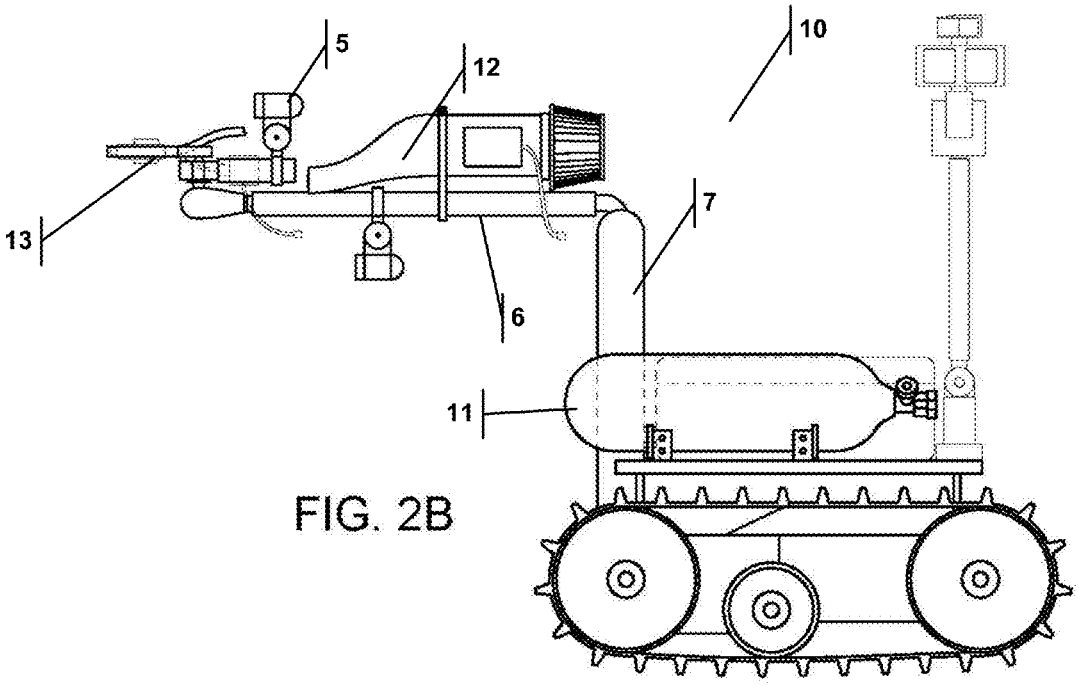
FIG. 2B is a left side view of the excavation system mounted on a robot.

An excavation system 10 of the present invention incorporated on a prior art robot is shown in FIGS. 2A and 2B. The excavation system 10 includes two air sources. One is a high-pressure air tank 11 and the other is a low-pressure high velocity blower 12. The air tank 11 is mounted on the mobile platform 2 and the high velocity blower 12 is mounted to the upper arm 6 of robot 1. The upper arm 6 also includes an evacuation valve 13. The system 10 includes a pressure control module 14 (PCM) mounted on the mobile platform 2 via PCM mounting bracket 15. The PCM 14 is in fluid communication with the evacuation valve 13 and the air tank 11. The PCM 14 regulates the high-pressure air (up to about 4500 PSI) in tank 11 to a pressure (about 300 PSI) that is employed by the evacuation valve 13. The PCM 14 is adjustable such that the regulated pressure may be varied. It would be understood that other pressures may be used to successfully excavate items. For example, in soft sand a lower pressure might be sufficient and preferable so as to allow more high-pressure pulses from the air tank 11 without a need for a recharge. A lower pressure may be utilized when uncovering an IED with a pressure plate. Alternatively, if the excavation needs to penetrate clay or other more densely packed materials, a higher pressure may be needed. As discussed in more detail below, the amount of pressure regulation may be controlled by a remote operation control unit (OCU).

Figure 3:
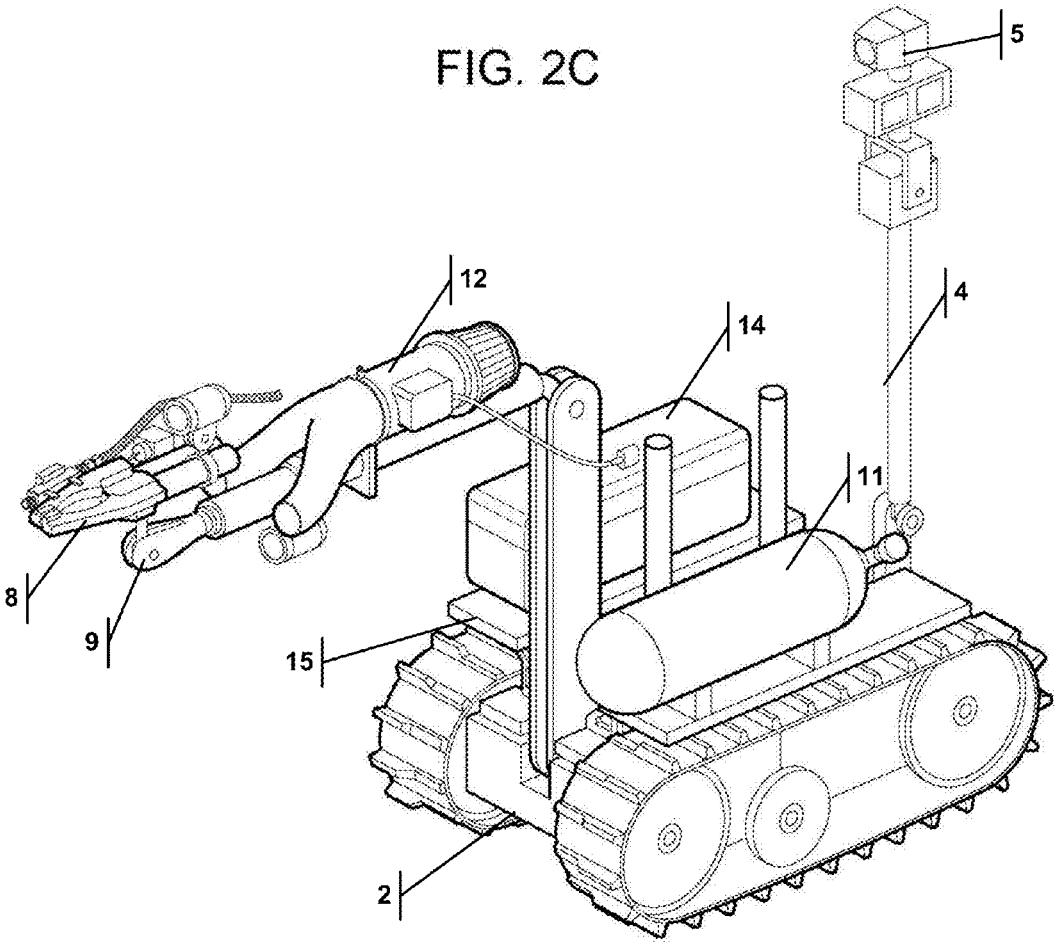
FIG. 3 is an elevation of the excavation system mounted a robot.

The air tank 11 and the PCM 14 may be mounted on different sides of the mobile platform 2 as seen in FIG. 3. This provides better balance and weight distribution to the mobile platform 2. The air tank 11 is located above one track 3 and the PCM 14 is located over the second track 3. An additional air tank may be employed to provide increased operation time of the excavation system 10. The additional air tank may be stacked over the first tank (not shown).

Figure 2C:
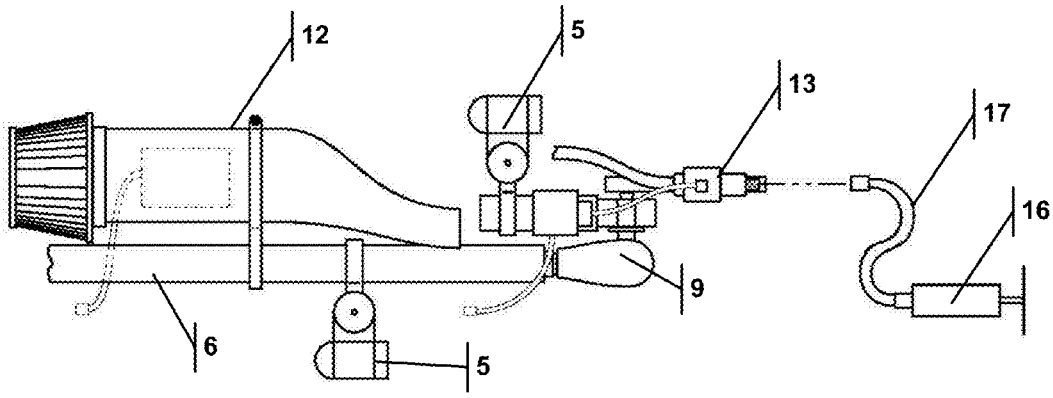
FIG. 2C is a side view of a variation of the system where a pneumatic tool can be operated by the system.
Figure 9:
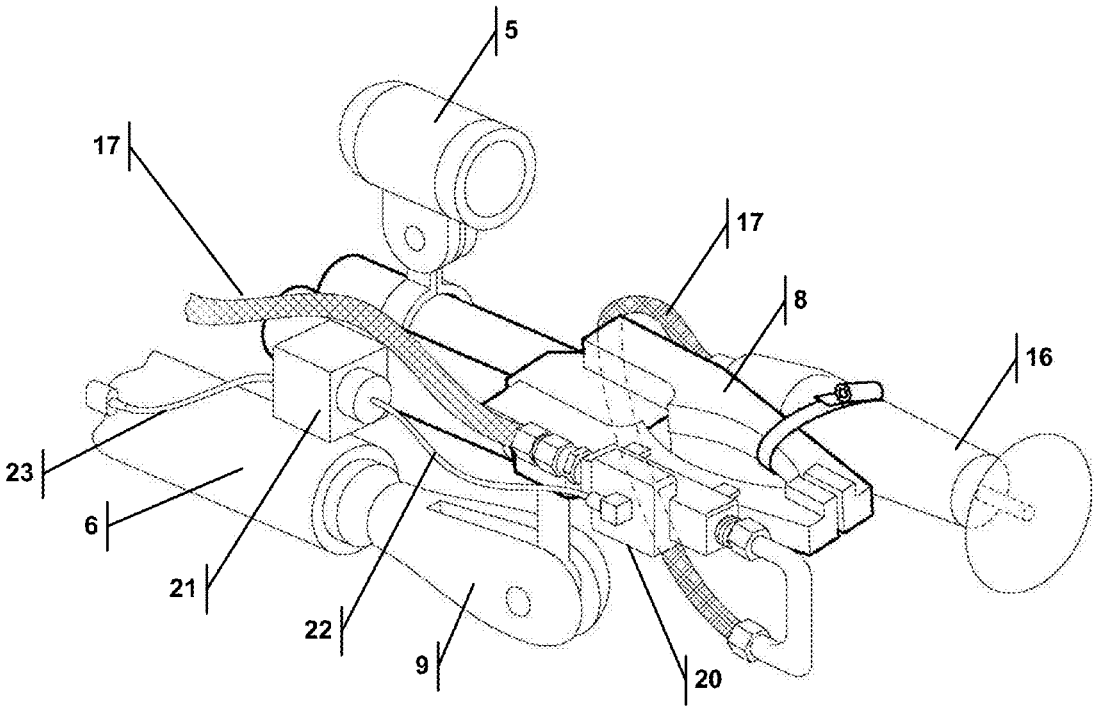
FIG. 9 is a close up view of the robot arm with evacuation valve of with an attached pneumatic tool.
Figure 12:
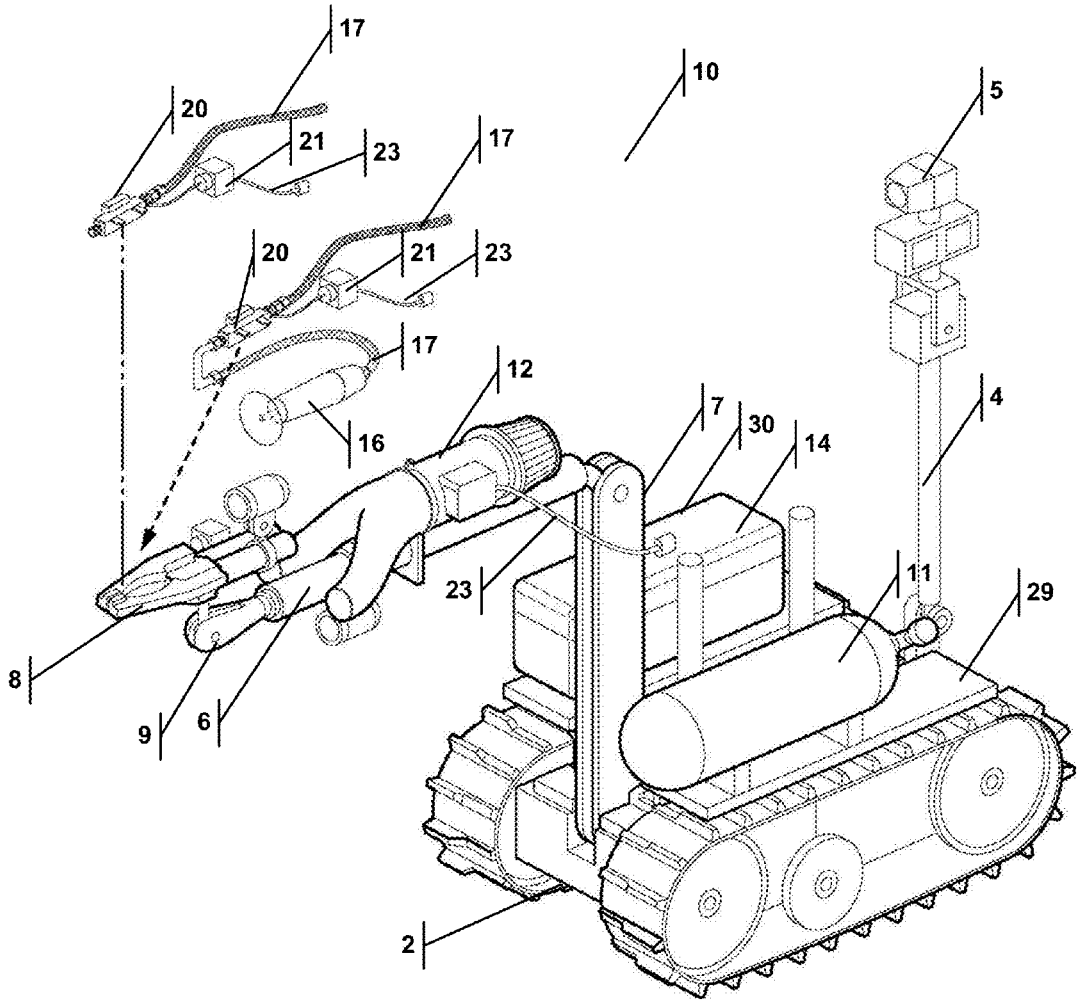
FIG. 12 is a partially exploded view of the excavating system with the evacuation valve and the evacuation valve connected to a pneumatic tool.

The excavation system 10 may be employed to drive a pneumatic tool such as a cut-off tool 16 seen in FIGS. 2C and 12. The system 10 may be employed to operate any other pneumatic tool such as but not limited to a chisel (not shown). A pneumatic tool may be fluidly connected via a flexible air hose 17 to the evacuation valve 13 or another valve (not shown) in place of the evacuation valve 13. The pneumatic tool may be attached to the gripper 8 as seen in FIG. 9.

Figure 4:
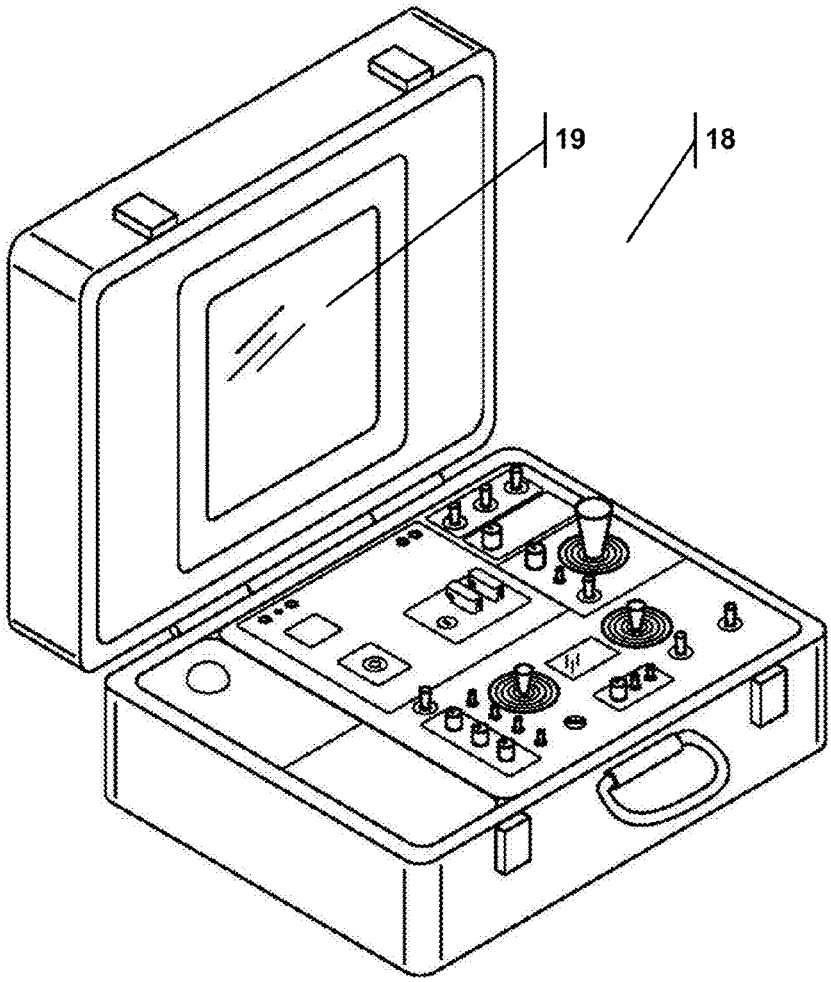
FIG. 4 is an elevation view of a controller for operating the robot and excavation system.
Figure 14:
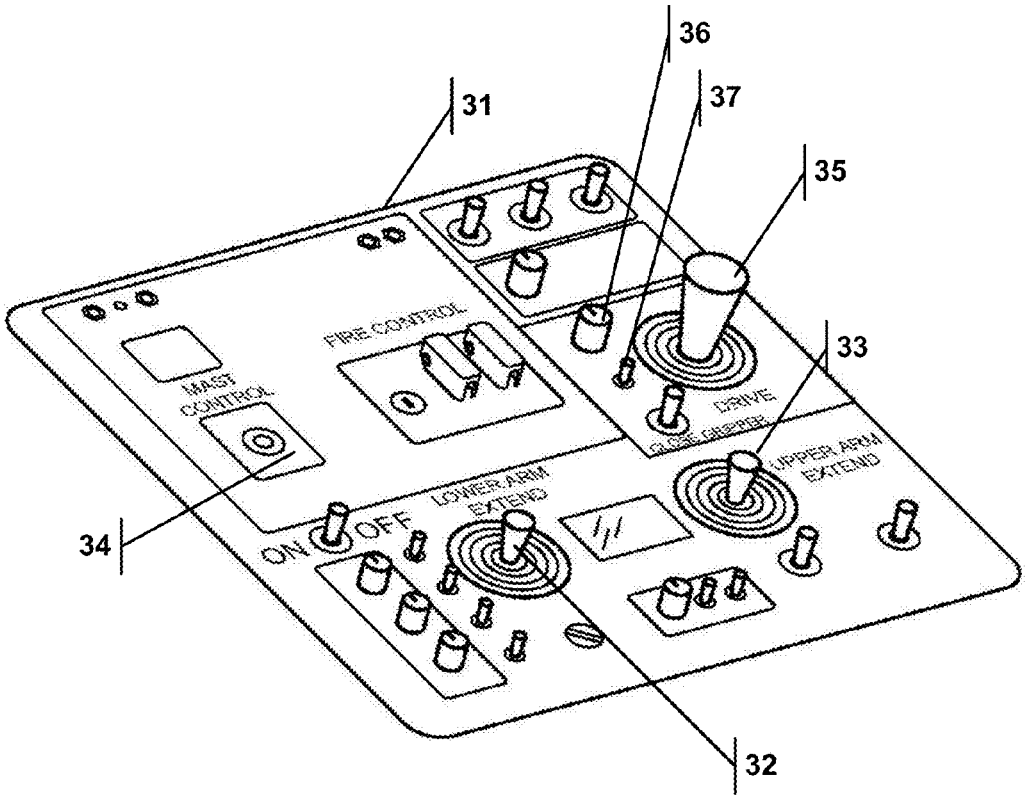
FIG. 14 is a close up view of the operation control unit modified for use with the excavating system.

The system includes an operation control unit (OCU) 18 as seen in FIGS. 4 and 14. An existing OCU 18 for the robot 1 is modified to control the excavation system 10. The OCU 18 is modified to employ an existing encrypted wireless communication channel to control the excavation system. This eliminates the need of setting up additional or a separate encrypted communication channel to control the excavation system 10. It also simplifies and speeds up the incorporation of the excavation system 10 to an existing robot 1.

It should be noted that the prior art robot have a very high level of encryption because they are often used in an active battle zone. The encryption prevents the enemy from hijacking the robot, thus rendering it useless or worse turning the robot against the operator. Because of this high-level of encryption, it may not be economical or even possible to add new encrypted channels to an existing robot. In a retrofit kit, it may be preferably to re-purpose an existing channel to operate the excavation system described herein. This would maintain the operational integrity of the robot, and lowers costs.

The OCU 18 wirelessly communicates with the robot 1 and the excavation system 10 via encrypted channels to provide secure communication. The OCU 18 may employ multiple encrypted channels to control the various parts of the robot 1 and the excavation system 10. The OCU 18 may include a video monitor 19 (FIG. 4) for displaying real time video feed or images from the multiple cameras 5 mounted on robot 1. The system 10 may be configured to allow a user to display multiple camera images on the monitor 19 at the same time. The excavation system 10 may be configured to allow the video monitor 19 to display air pressure data for various locations or parts of the system. The displayed pressures may include but are not limited to tank pressure, dome pressure (pressure in the dome of the first regulator valve), and jet pressure. A video pressure overlay unit (not shown) may be employed to provide the video monitor 19 with the pressure data on a real time basis by overlaying the pressure data on the encrypted video signal. Again, piggybacking on the existing encrypted transmissions between the robot and the OCU maintains operational integrity.

Figure 5:
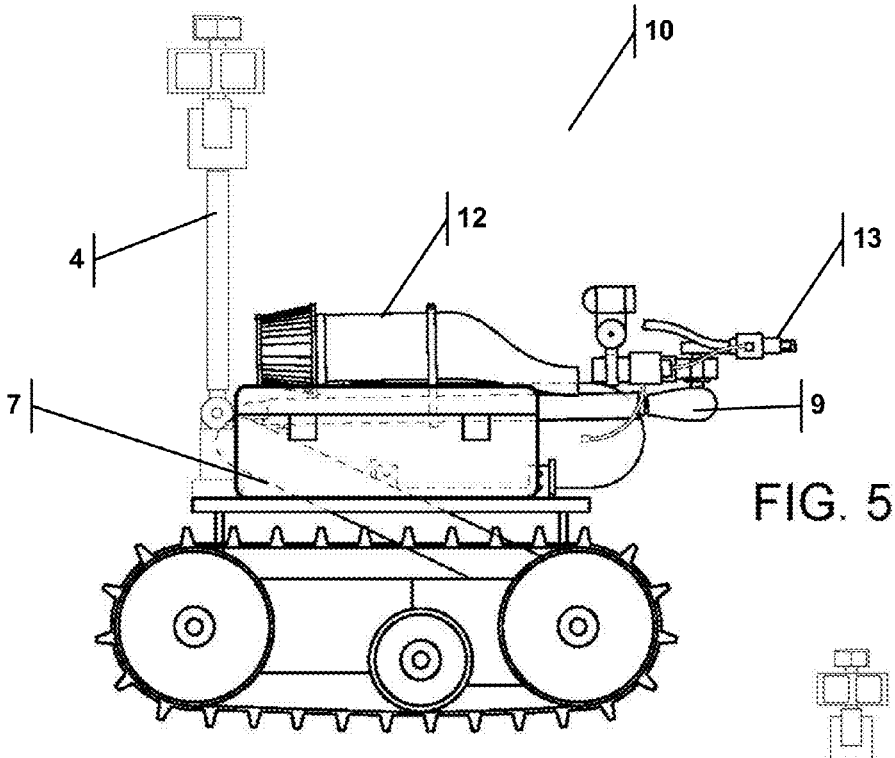
FIG. 5 is a right side view of the excavation system with the robot arm in the fully stowed position.
Figure 6:
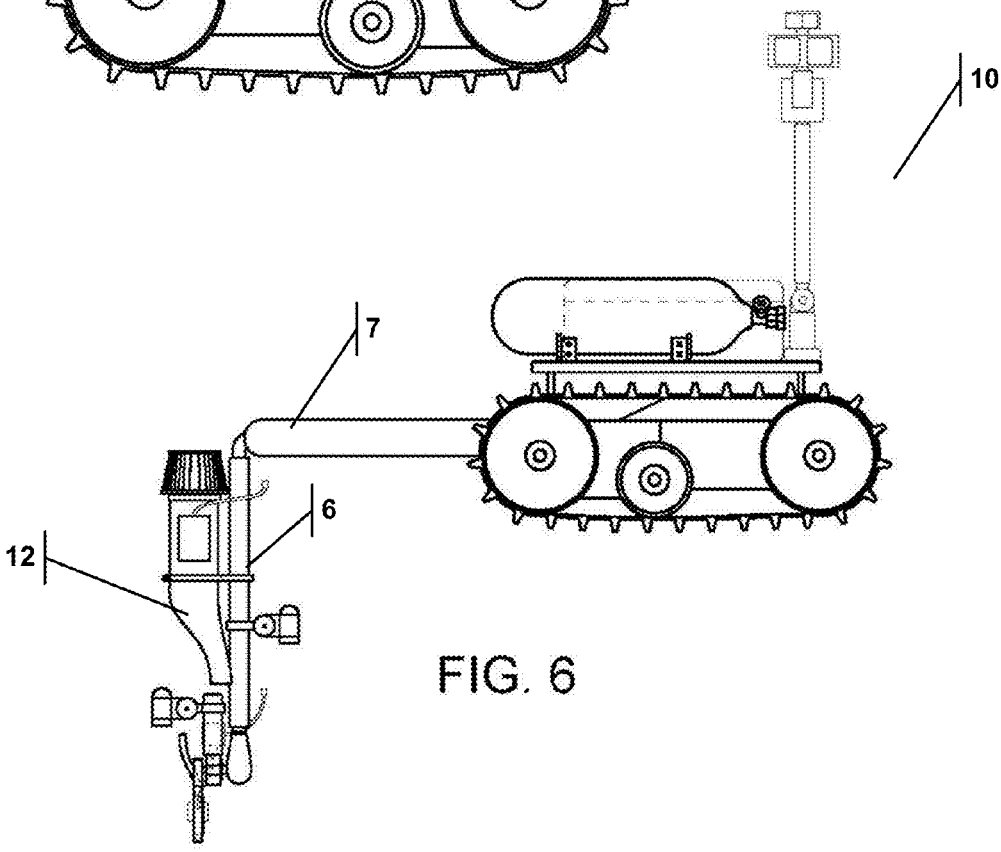
FIG. 6 is a left side view of the excavation system with the robot arm in a downward extended position.

The upper and lower arms 6,7 of the robot 1 can be moved to a variety of positions as seen in FIGS. 3, 5, and 6. FIG. 5 shows the upper arm 6 and the lower arm 7 (shown in dashed lines) in a fully stowed position where the upper and lower arms 6,7 drop in between the air tank 11 and the PCM 14. FIG. 6 shows the upper arm 6 in a downwardly extended position where upper arm 6 could be in an excavation site in the ground.

Figure 7:
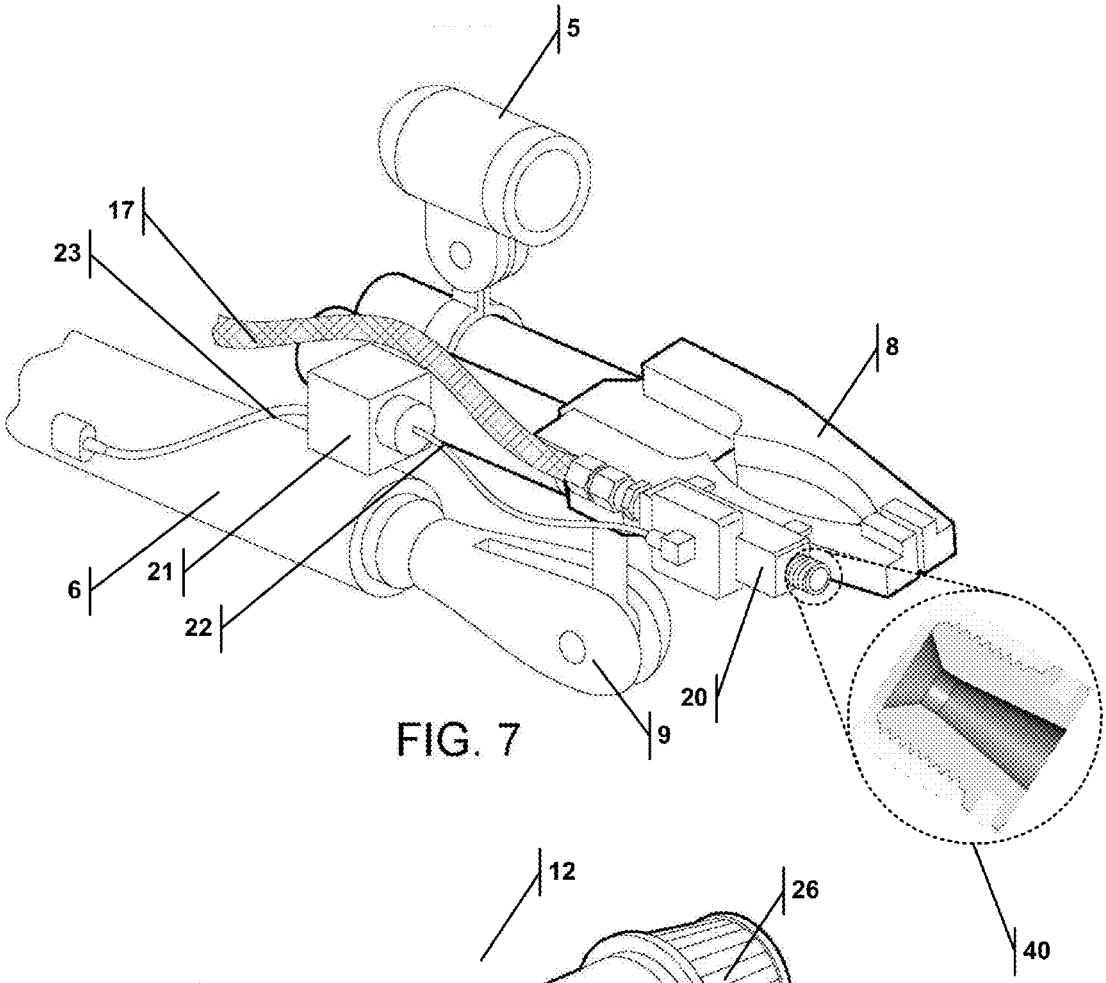
FIG. 7 is a close up view of the robot arm with gripper and the evacuation valve of the excavation system.

A close up of the end of upper arm 6 is shown in FIG. 7. The evacuation valve 13 includes a first valve 20 and a second valve 21, where the second valve 21 is remotely located from the first valve 20. The second valve 21 controls the operation of the first valve 20 to produce the high-pressure pulsed air jet out of the nozzle 40 (shown in an exploded view). The nozzle 40 may be a De Laval nozzle such as the one disclosed in U.S. Pat. No. 522,066. A tube 22 connects the second valve 21 to the first valve 20 allowing the second valve 21 to control (i.e. the opening and closing) the first valve 20. The second valve 21 may be a solenoid valve or a pilot valve. The second valve 21 can control the first valve 20 pneumatically via the tube 22. The pneumatic control may be replaced with an electrical control or another suitable type of control. The gripper 8 may support the first valve 20. The second valve 21 is remotely located from the first valve 20 to provide a narrower profile to the end of arm 6. The second valve 21 is electrically connected to the PCM 14 by a suitable electric cable 23 or other connection mechanism (connection to PCM not shown). The high-pressure air jet has a pulse width or duration that is user selectable, i.e., it can be varied or controlled by the user. The duration may be in the order of about 30 to about 140 milliseconds. The high-pressure air jet has a delay between pulses that is also user selectable. The pulse delay may be in the order of about 0.25 seconds to about 2.3 seconds.

The second valve 21 is located within approximately 6 inches of the first valve 12, so that the first valve 20 may be opened and shut quickly because it is necessary to conserve compressed air. The remote location of the second valve 21 allows the gripper 8 to operate freely, without compromising the ability of the gripper 8 to reach buried objects.

Figure 8:
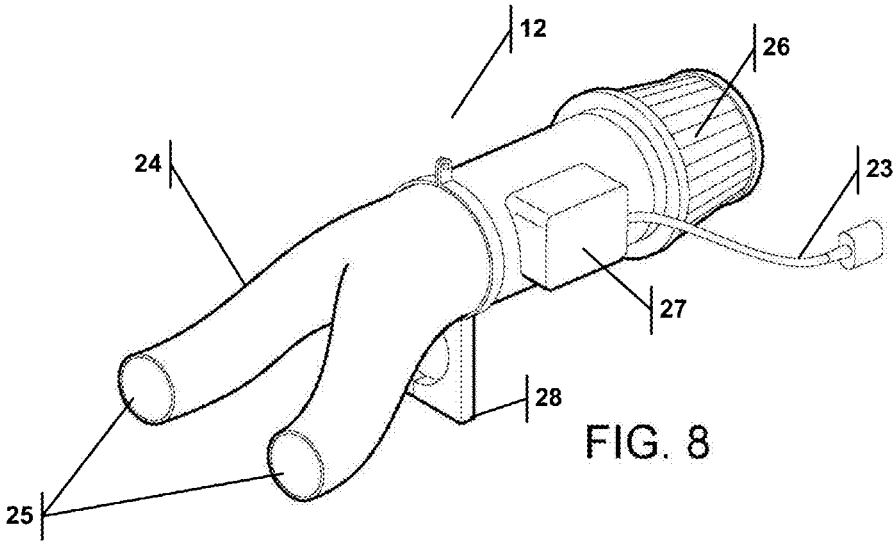
FIG. 8 is an elevation view of the low-pressure high velocity blower.

The low-pressure high velocity blower 12 is shown in FIG. 8. The high velocity blower 12 puts out a continuous flow of air. The high-pressure air jet puts out a pulsed or intermittent flow of air. The low-pressure high velocity air from the blower 12 improves the digging capability of the system 10 by assisting in the clearing or removal of the debris dislodged by the high-pressure pulsed air jet. The air from the blower 12 also prevents debris from falling back into the excavation site. The blower 12 preferably includes a bifurcated fan duct 24 with two air outlets 25 and an air inlet or intake (not shown). The air outlets 25 may be provided with mesh or screen covers (not shown). An air filter 26 is placed over the air inlet in the end of the bifurcated fan duct 24. The air filter 26 seals and covers the air inlet and filters any air entering therein. The blower 12 includes an axial fan (not shown) located inside the inlet end of the bifurcated fan duct 24. A fan control module 27 (FCM) is employed to control operation of the fan. The FCM 27 may be mounted on the outside of the bifurcated fan duct 24 or any other suitable location. The FCM 27 is preferably located in close proximity to the fan. The blower 12 has a fan duct mounting bracket 28 for securing the blower 12 to the upper arm 6 as seen in FIGS. 10 and 11.

Figure 10:
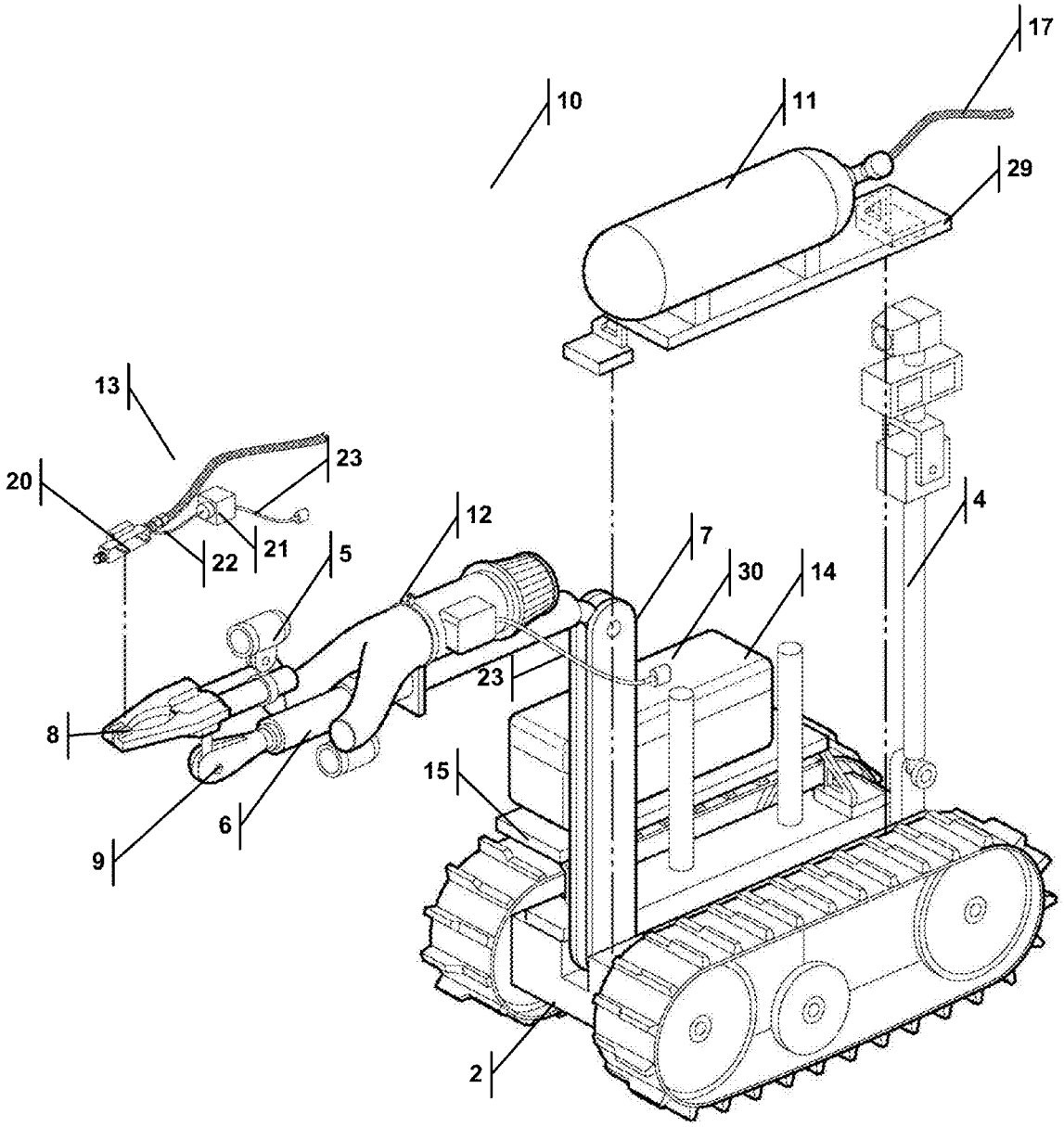
FIG. 10 is a partially exploded view of the excavation system with the evacuation valve and the high-pressure air tank removed.
Figure 11:
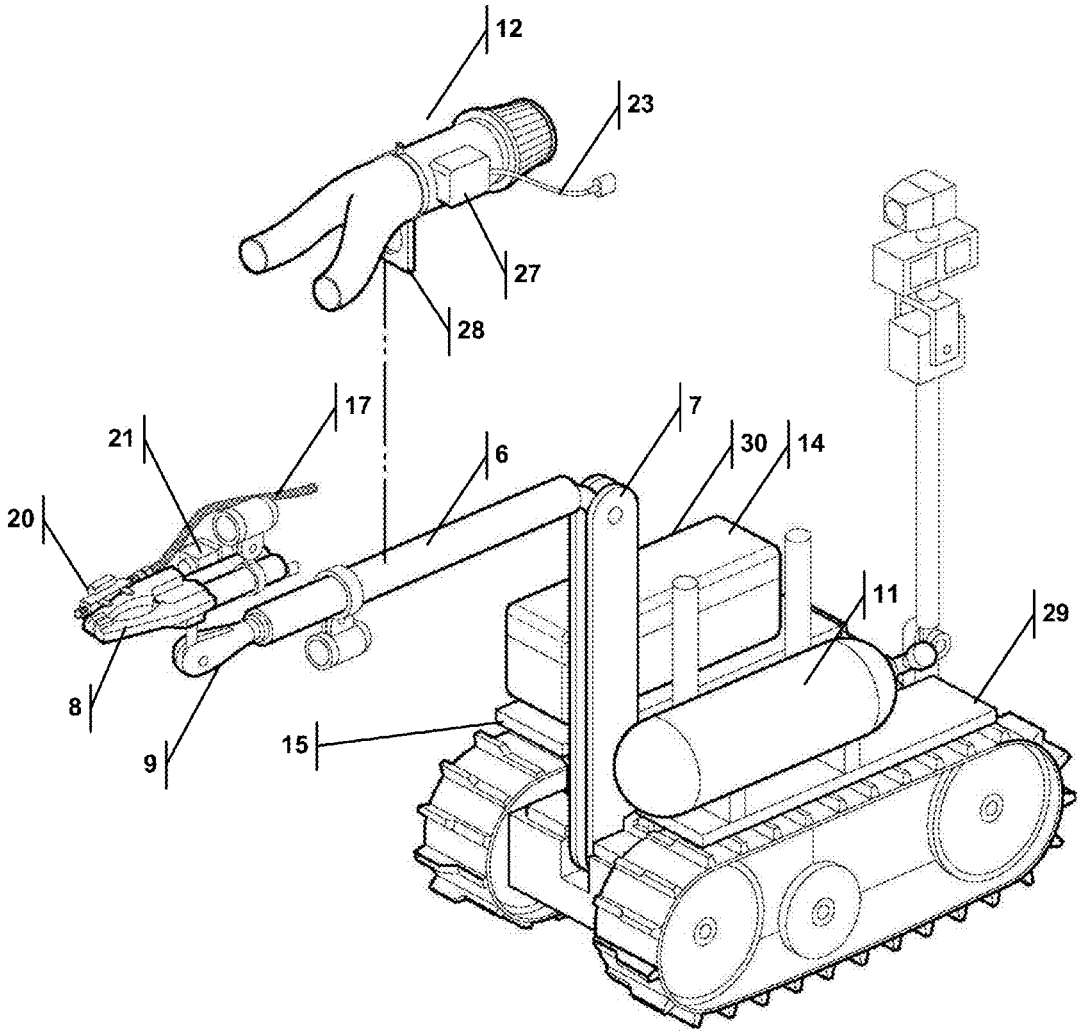
FIG. 11 is a partially exploded view of the excavation system with the low-pressure high velocity air source removed.

Looking at FIG. 10 the excavation system 10 is shown with the air tank 11 and its tank mounting bracket 29 removed from the mobile platform 2 and with the evacuation valve 13 removed from the gripper 8. The FCM 27 is electrically connected to the PCM 14 via a suitable electric cable 23. The blower 12 is positioned rearward of the gripper 8 to provide clearance between the gripper 8 and the blower 12. This enables the end of upper arm 6 to rotate without interfering with the bifurcated fan duct 24.

Figure 13:
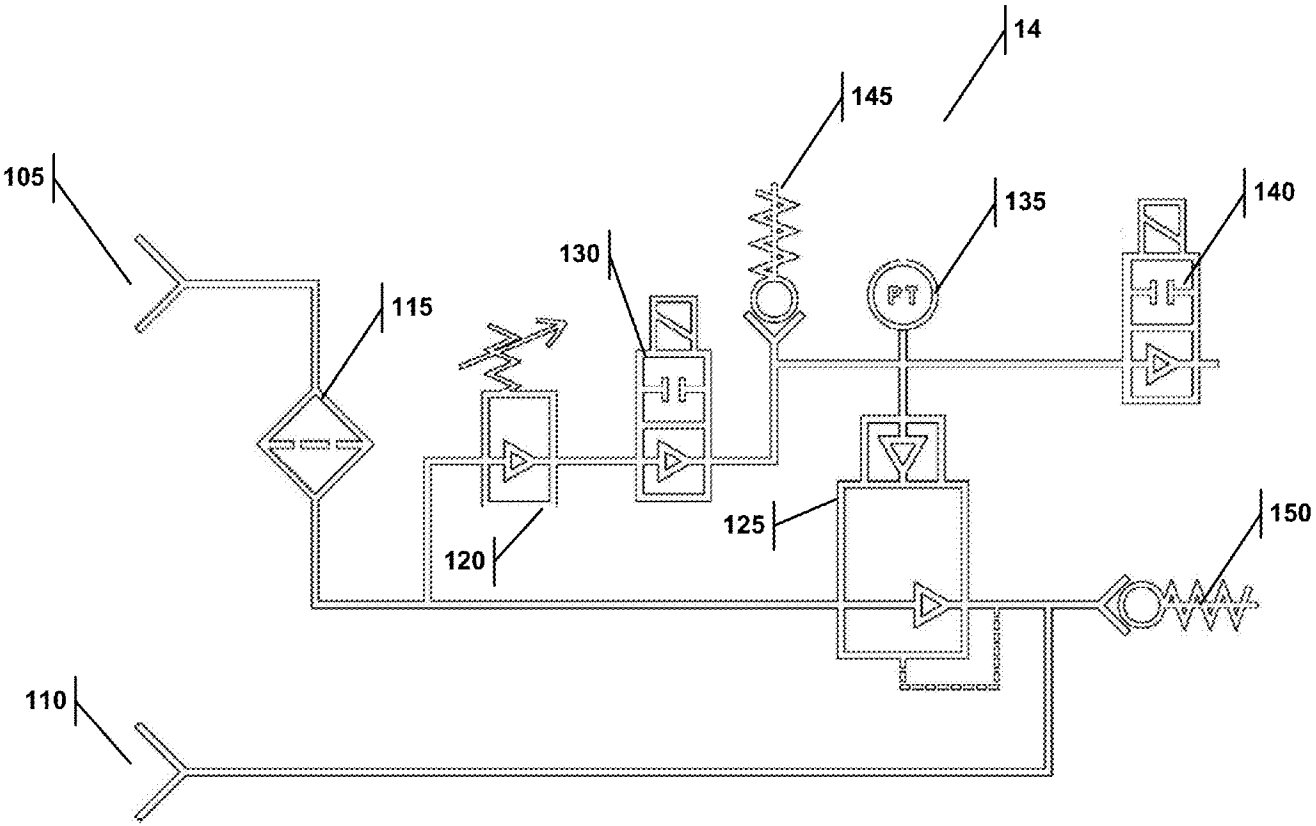
FIG. 13 is a schematic of the pressure control module.

In FIG. 13 a schematic of the PCM is shown in more detail. The PCM 14 includes the high-pressure input 105 from the from the high-pressure air tank 11 to a lower pressure outlet 110 supplied to the evacuation valve 13. The PCM 14 may include a filter 115 two pressure regulator valves 120, 125 where the second valve 120 is employed to provide remote operation of the first pressure regulator valve 125. The first pressure regulator valve 125 may be a dome-loaded high flow regulator valve. The second pressure regulator valve 120 is used to provide pressure to the dome input of the first regulator valve. The second pressure regulator valve 120 is connected to a solenoid valve 130 which is then connected to a pressure transducer 135, and provides for remote control operation of the first pressure regulator valve 125 by varying the pressure provided to the dome input. The second pressure regulator valve 120 may also be connected to a solenoid valve 140 that vents the pressure to atmosphere, as well as a dome pressure relief valve 145 that vents to atmosphere. The first pressure regulator valve 125 may also be connected to a pressure relief valve 150 to vent to atmosphere.

The PCM 14 includes a high-pressure air inlet 105 and a lower pressure air outlet 110. The air inlet 105 is connected to the air tank 11 by a suitable conduit or flexible hose and PCM may incorporate a high-pressure hose connector at the air inlet. The hose or conduit connecting the air tank 11 to PCM must be capable of withstanding the high-pressure air in tank 11. The air outlet 110 is connected to the evacuation valve 13 and the PCM may incorporate a lower pressure hose connector such as but not limited to an AN-8 connector. The air outlet 110 is connected to the first valve 20 (of the evacuation valve 13) as seen in FIGS. 7 and 10 by a suitable conduit or a flexible hose 17 (connection to air outlet not shown). The system 10 may be configured to allow a user to control and vary the air pressure exiting the air outlet during the operation of the excavation system 10 via the OCU 18. The housing 30 of the PCM 14 may be a watertight case such as those sold under the PELICAN brand name. This is not intended to be limiting and any suitable housing 30 that will protect its internal components may enclose the PCM 14.

FIG. 14 is a close up of the control panel 31 of the OCU 18. The control panel 31 of the OCU 18 is shown including a lower arm control 32, an upper arm control 33, a mast control 34, and a mobile platform drive control 35. These controls are employed to move and operate their respective elements (i.e. the mobile platform drive control operates the mobile platform). The OCU 18 may also be provided with a control for the operation of a pneumatic tool (not shown). The OCU 18 may be provided with a selector switch 36 that would allow the air jet and high velocity blower 12 to operate at the same time or independently of each other. An on/off switch 37 incorporated in the OCU 18 as seen in FIG. 14 may operate the high-pressure pulsed air jet and the low-pressure high velocity blower. These switches 36, 37 employ an existing encrypted communication channel or channels in the OCU 18 which is described in further detail below with reference to FIGS. 15A-C. Other switches or controls to operate the excavation system 10 may be employed.

Figures 15A, 15B, 15C:
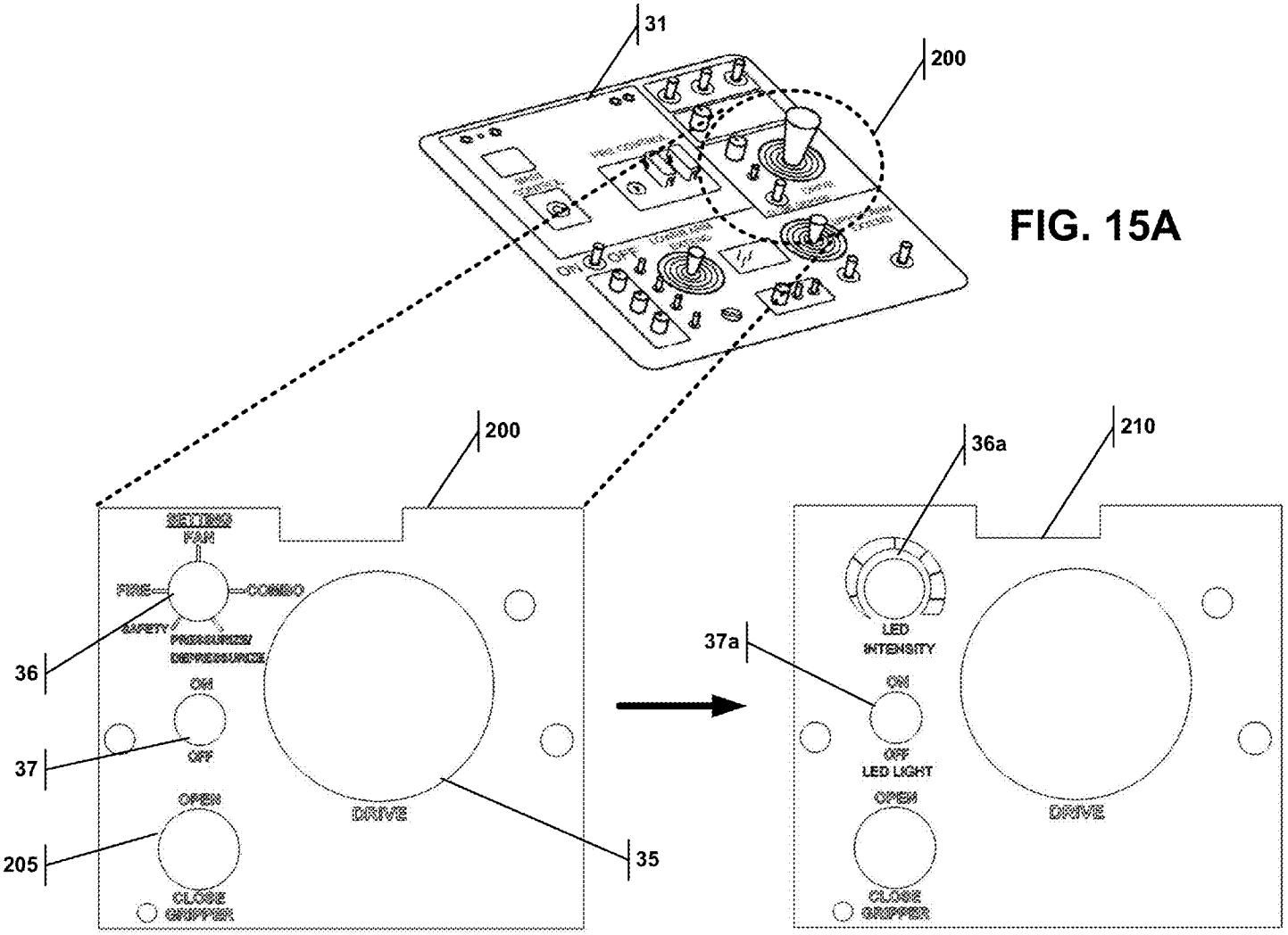
FIG. 15A is a close up view of the operation control unit modified for use with the excavating system.
FIG. 15B is a map view of the operation control unit modified for use with the excavating system.
FIG. 15C is a map view of the operation control unit from an existing robot without pneumatic excavating components.

FIGS. 15A, B and B C further detail the repurposing of existing encrypted communication channels. FIG. 15A illustrates the OCU 31 of the robot that contains several switches. FIG. 15B illustrates a portion of the OCU 200 that includes the switches 36 and 37 that control the pneumatic excavation components, and a mobile platform drive control 35. The OCU portion 200 also includes button 205 to actuate the gripper. In FIG. 15C, the original OCU portion 210 of the robot is shown. The original robot does not have the pneumatic excavation components, and instead has switches 36*a* and 37*a* to control power to an LED and the intensity of the LED. The output for these switches on the robot have been connected to the pneumatic excavation components described herein. The new features include selector switch 36 (repurposed from switch 36*a*) which would allow the air jet and high velocity blower 12 to operate at the same time or independently of each other and on/off switch 37 (repurposed from switch 37*a*) to operate the high-pressure pulsed air jet and the low-pressure high velocity blower. Optionally, the OCU portion 210 may include a physical plate that lays over the existing OCU 31, relabeling the switches so as to assist the robot operator.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips v. AHW Corp.*, 415 F.3d 1303, 1323 (Fed. Cir. 2005) (en banc).

The invention claimed is:

1. A kit for use on a robot system, the robot system comprising a robot with an arm and a operation control unit (OCU) for remotely controlling the robot over a plurality of pre-existing wireless encrypted channels, the kit comprising:

a nozzle for delivering a high-pressure pulsed air jet, wherein the nozzle is adapted to be mounted on the arm;

a first valve for connection with the nozzle;

a high pressure air source for connection to the first valve wherein the first valve and high pressure air source are adapted to be mounted to the robot; and wherein the first valve is connected to at least one of the pre-existing wireless encrypted channels, such that the OCU can operate the first valve.

2. The kit of claim 1, further comprising:

a low-pressure high velocity blower, wherein the blower is adapted to be mounted adjacent to the nozzle; and wherein the blower is connected to at least one of the pre-existing wireless encrypted channels, such that the OCU can operate the blower.

3. The kit of claim 1, wherein the high-pressure air source is a tank with compressed air.

4. The kit of claim 1 further comprising a pressure control module (PCM) for regulating air pressure from the high-pressure air source to the first valve.

5. The kit claim 4, wherein the PCM further comprises first and second pressure regulator valves for reducing the pressure from the high-pressure air source.

6. The kit of claim 2, wherein the high velocity blower further comprises a bifurcated duct with an axial fan and a fan control module.

7. The kit of claim 4 further comprising a second valve controlling the first valve wherein the second valve is in electrical communication with the PCM.

8. The kit of claim 1, wherein the OCU includes a display screen adapted to display status information transmitted from the robot over the pre-existing wireless encrypted channel, wherein the information includes air pressure data regarding the high pressure air source.

9. The kit of claim 1, wherein the high-pressure pulsed air jet has a pulse width and a pulse delay that are user selectable.

10. The kit of claim 4, wherein the PCM has an air outlet connected to the first valve with an outlet pressure and the OCU is configured to allow the user to vary the outlet pressure during operation.

11. A method of excavating, the method comprising the steps of:

providing a kit for use on a robot system, the robot system comprising a robot with an arm and a operation control unit (OCU) for remotely controlling the operation of features on the robot over a plurality of pre-existing wireless encrypted channels, the kit comprising:

a nozzle for delivering a high-pressure pulsed air jet, wherein the nozzles is adapted to be mounted on the arm;

a first valve for connection with the nozzle;

a high pressure air source for connection to the first valve wherein the first valve and high pressure air source are adapted to be mounted to the robot; and wherein the first valve is connected to at least one of the pre-existing wireless encrypted channels, such that the OCU can operate the first valve;

actuating, over at least one of the pre-existing wireless encrypted channels, the first valve to create a high-pressure pulsed air jet to dislodge a material from a target site.

12. The method of claim 11, further comprising the steps of:

providing a low-pressure high velocity blower, wherein the blower is adapted to be mounted adjacent to the nozzle; and wherein the blower is connected to at least one of the pre-existing wireless encrypted channels, such that the OCU can operate the blower;

actuating, over at least one of the pre-existing wireless encrypted channels, the low-pressure high velocity blower to remove the material from the target site.

13. The method of claim 11 further comprising:

providing a pressure control module (PCM) for regulating air pressure from the high-pressure air source to the first valve; and regulating the air pressure from the high-pressure air source to the first valve.

14. The method of claim 11, wherein the OCU includes a display screen adapted to display information transmitted from the robot over the pre-existing wireless encrypted channel, the method further comprising:

transmitting air pressure data regarding the high pressure air source from the robot to the OCU; and displaying the air pressure data on the display screen.

* * * * *